US007439942B2

(12) United States Patent
Choi

(10) Patent No.: US 7,439,942 B2
(45) Date of Patent: Oct. 21, 2008

(54) PLASMA DISPLAY PANEL DRIVING APPARATUS

(75) Inventor: Hak-Ki Choi, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 292 days.

(21) Appl. No.: 11/270,467

(22) Filed: Nov. 10, 2005

(65) Prior Publication Data

US 2006/0103605 A1 May 18, 2006

(30) Foreign Application Priority Data

Nov. 12, 2004 (KR) ..... 10-2004-0092354

(51) Int. Cl.
*G09G 3/28* (2006.01)

(52) U.S. Cl. ..... 345/60; 345/62; 345/66; 345/68

(58) Field of Classification Search ..... 345/37–41, 345/60–69; 315/169.1–169.4
See application file for complete search history.

(56) References Cited

U.S. PATENT DOCUMENTS

2006/0043908 A1* 3/2006 Cho et al. ..... 315/276
2006/0097959 A1* 5/2006 Bezal et al. ..... 345/60
2007/0091017 A1* 4/2007 Kwak et al. ..... 345/60

FOREIGN PATENT DOCUMENTS

| | | |
|---|---|---|
| JP | 09325735 | 12/1997 |
| JP | 2002215084 | 7/2002 |
| JP | 2002366095 | 12/2002 |

* cited by examiner

*Primary Examiner*—Vijay Shankar
(74) *Attorney, Agent, or Firm*—H.C. Park & Associates, PLC

(57) ABSTRACT

A plasma display panel driving apparatus for applying a voltage to an electrode of the plasma display panel. The apparatus includes a first voltage applying unit to apply a first voltage and a third voltage to the electrode, and a second voltage applying unit to apply a second voltage to the electrode. The second voltage is higher than the first voltage. An energy recovery circuit includes an inductor and an over-voltage clamping preventing unit, which maintains a connection node in a voltage range from the first voltage to the third voltage. The over-voltage clamping preventing unit comprises a second diode coupled with the connection node, a third diode coupled with the connection node, and a fourth switching element coupled with the second diode and a first voltage source that supplies the first voltage.

16 Claims, 10 Drawing Sheets

PLASMA DISPLAY PANEL DRIVING APPARATUS

CROSS-REFERENCE TO RELATED PATENT APPLICATION

This application claims priority to and the benefit of Korean Patent Application No. 10-2004-0092354, filed on Nov. 12, 2004, which is hereby incorporated by reference for all purposes as if fully set forth herein.

BACKGROUND OF THE INVENTION

1. Field of the Invention

The present invention relates to a plasma display panel (PDP) driving apparatus, and more particularly, to a PDP driving apparatus for applying a voltage to electrodes of the PDP.

2. Discussion of the Background

FIG. 1 shows a conventional three-electrode surface discharge PDP.

Referring to FIG. 1, the conventional surface discharge PDP 1 includes front and rear glass substrates 100 and 106. Address electrode lines A1, . . . , Am, front and rear dielectric layers 102 and 110, scan electrode lines Y1, . . . , Yn, sustain electrode lines X1, . . . , Xn, a fluorescent layer 112, barrier ribs 114, and a protective layer 104 are arranged between the front and rear glass substrates 100 and 106. The protective layer 104 may be made of, for example, magnesium oxide (MgO).

The address electrode lines A1, . . . , Am are arranged on an upper surface of the rear glass substrate 106 in a predetermined pattern, and the rear dielectric layer 110 covers the address electrode lines A1, . . . , Am. The barrier ribs 114, which define discharge cells, are arranged on an upper surface of the rear dielectric layer 110 and are substantially parallel to the address electrode lines A1, . . . , Am. The barrier ribs 114 prevent optical crosstalk between discharge cells. The fluorescent layer 112 is arranged on sides of the barrier ribs 114 and the upper surface of the rear dielectric layer 110 not covered by the barrier ribs 114.

The sustain electrode lines X1, . . . , Xn and the scan electrode lines Y1, . . . , Yn are arranged on a lower surface of the front glass substrate 100 in a predetermined pattern to cross the address electrode lines A1, . . . , Am. Discharge cells are provided to correspond to the crossing points. The sustain electrode lines X1, . . . , Xn and the scan electrode lines Y1, . . . , Yn may include transparent electrode lines Xna, . . . , Yna and metallic electrode lines Xnb, . . . , Ynb, respectively. The transparent electrode lines Xna, . . . , Yna may be made of a conductive transparent material such as indium tin oxide (ITO). The metallic electrode lines Xnb, . . . , Ynb increase the conductivity of the sustain electrode lines. The front dielectric layer 102 covers the sustain electrode lines X1, . . . , Xn and the scan electrode lines X1, . . . , Yn. The protective layer 104, which protects the PDP 1 from a strong electric field, covers the front dielectric layer 102. A discharge space 108 is filled with a plasma-forming discharge gas.

Generally, driving operations of the PDP 1 are divided into reset, address, and sustain discharge periods PR, PA, and PS, which are sequentially performed in individual subfields. In the reset period PR, all discharge cells are provided with a substantially uniform charge state. In the address period PA, the discharge cells to be turned on are selected. In the sustain discharge period PS, sustain discharge is performed in the selected discharge cells, thereby generating plasma from the plasma-forming discharge gas. In turn, ultraviolet (UV) light emitted from the plasma excites the fluorescent layer coated in the discharge cells, and the fluorescent layer emits light as it transitions from an excited state to a ground state. The emitted light forms images displayed by the PDP.

FIG. 2 shows a conventional PDP driving apparatus for the PDP of FIG. 1.

Referring to FIG. 2, the PDP driving apparatus includes an image processor 200, a logic controller 202, an address driver 206, an X driver 208, and a Y driver 204. The image processor 200 outputs image signals (i.e. internal image signals) after processing an input image signal. For example, the internal image signals may include 8-bit R, G, B image data, a clock signal, a horizontal synchronization signal, and a vertical synchronization signal. The logic controller 202 generates driving control signals including an address signal $S_A$, a Y driving control signal $S_Y$, and an X driving control signal $S_X$. The address driver 206 generates a display data signal by processing the address signal $S_A$ and applies the display data signal to the address electrode lines A1, . . . , Am. The X driver 208 processes the X driving control signal $S_X$ and applies the processed X driving control signal $S_X$ to the sustain electrode lines X1, . . . , Xn. The Y driver 204 processes the Y driving control signal $S_Y$ and applies the processed Y driving control signal $S_Y$ to the scan electrode lines Y1, . . . , Yn.

FIG. 3 shows an address display separation (ADS) driving scheme for the scan electrode lines in the PDP of FIG. 1.

In order to perform time-division gray display, a unit frame may be divided into a predetermined number of subfields, typically, 8 subfields SF1, . . . , and SF8. Each subfield SF1, . . . , and SF8 may be divided into a reset period (not shown), an address period A1 . . . , A8, and a sustain discharge period S1 . . . , S8.

In the address period A1 . . . , A8, display data signals are applied to the address electrode lines A1, . . . , Am, and scan pulses are sequentially applied to the scan electrode lines Y1, . . . , Yn, to generate wall charges in selected discharge cells.

In the sustain discharge period S1, . . . , S8, sustain pulses are alternately applied to the scan electrode lines Y1, . . . , Yn and the sustain electrode lines X1, . . . , Xn to generate a sustain discharge in the selected discharge cells.

PDP's brightness is proportional to the number of sustain discharge pulses in the sustain discharge periods S1, . . . , and S8 of one unit frame. In a case where one image is represented in 256 gray scales by using one frame having 8 subfields, sustain pulses having different ratios of 1, 2, 4, 8, 16, 32, 64, and 128 may be allocated to the 8 subfields SF1, . . . , and SF8, respectively. Hence, for example, a brightness of a 133 gray scale may be obtained by addressing and sustain-discharging a discharge cell in the first, third, and eighth subfields SF1, SF3, and SF8.

The number of sustain discharge pulses allocated to each subfield may be determined according to weighting factors for the subfields in an automatic power control (APC) stage. Additionally, the number of the sustain discharge pulses allocated to the subfields may be determined according to gamma characteristics or panel characteristics. For example, the gray scale allocated to the fourth subfield SF4 may be decreased from 8 to 6, and the gray scale allocated to the sixth subfield SF6 may be increased from 32 to 34. Further, the number of subfields in one frame may be determined according to a design specification.

FIG. 4 shows a timing diagram of driving signals that may be used to drive the PDP of FIG. 1. Referring to FIG. 4, the driving signals are applied to the address electrode lines A1, . . . , Am, the sustain electrode lines X1, . . . , Xn, and the scan electrode lines Y1, . . . , Yn, and a subfield SF may include a reset period PR, an address period PA, and a sustain discharge period PS.

In the reset period PR, a reset pulse is applied to the scan electrode lines Y1, . . . , Yn to initialize wall charge states of all discharge cells. The reset pulse may include a rising ramp followed by a falling ramp. Applying the rising ramp to the scan electrode lines Y1, . . . , Yn increases the voltage of each scan electrode line Y1, . . . , Yn from the sustain discharge voltage Vs to a highest rising voltage Vset+Vs. Applying the falling ramp to the scan electrode lines Y1, . . . , Yn decreases the voltage each scan electrode line Y1, . . . , Yn from the sustain discharge voltage Vs to a lowest falling voltage Vnf. When applying the falling ramp, a bias voltage Ve is applied to the sustain electrode lines X1, . . . , Xn, and a ground voltage Vg is applied to the address electrode lines A1, . . . , Am. As FIG. 4 shows, the bias voltage Ve may be higher than the sustain discharge voltage Vs.

In the address period PA, in order to select discharge cells to be turned on, scan pulses having a voltage Vscl are sequentially applied to the scan electrode lines Y1, . . . , Yn. Here, unselected scan electrode lines are biased at a high scan voltage Vsch. A display data signal having an address voltage Va is simultaneously applied to the address electrode lines A1, . . . , Am to select the corresponding discharge cells. The sustain electrode lines X1, . . . , Xn are biased at the bias voltage Ve during the address period PA.

In the sustain discharge period PS, in order to sustain-discharge the discharge cells selected in the address period PA, a sustain pulse having a sustain discharge voltage Vs is alternately applied to the scan electrode lines Y1, . . . , Yn and the sustain electrode lines X1, . . . , Xn.

FIG. 5 shows an example of the X driver in the PDP driving apparatus of FIG. 2.

Referring to FIG. 5, the X driver 208 includes a first voltage switching unit 55, a second voltage switching unit 57, a main switching unit 59, and an energy recovery circuit 53. The first voltage switching unit 55 applies a sustain pulse having a sustain discharge voltage Vs and a ground voltage Vg to the sustain electrode lines X1, . . . , Xn, and the second voltage switching unit 57 applies a bias voltage Ve to the sustain electrode lines X1, . . . , Xn. The main switching unit 59 separates application of the bias voltage Ve from application of the sustain discharge voltage Vs and the ground voltage Vg, and the energy recovery circuit 53 collects charges in the discharge cells or emits collected charges into the discharge cells.

Hereinafter, the PDP is referred to as a panel capacitor. Additionally, the panel capacitor may denote a discharge cell.

The energy recovery circuit 53 includes an inductor L1, an over-voltage clamping preventing unit 52, an energy recovery switching unit 51, and an energy storage unit 54. The inductor L1 has one terminal coupled with the main switching unit 59. The over-voltage clamping preventing unit 52 has two diodes D2 and D3 coupled with the connection node N1 (the other terminal of the inductor L1) to maintain the connection node N1 within a voltage range from the sustain discharge voltage Vs to the ground voltage Vg. The energy recovery switching unit 51 has two diodes D4 and D5 coupled with the connection node N1, and two switching elements S5 and S6 coupled with the diodes D4 and D5, respectively, to collect the charges in the panel capacitor Cp or apply collected charges to the panel capacitor Cp. The energy storage unit 54 stores the collected charges and emits the stored charges to the panel capacitor Cp.

If the bias voltage Ve exceeds the sustain discharge voltage Vs as shown in FIG. 4, the X driver 208 prevents a current from flowing from the second voltage switching unit 57 to the first voltage switching unit 55 by turning the main switching unit 59 on and off. Since a large current flows in the main switching unit 59, the main switching unit 59 must have a sufficiently large current capacity. Conventionally, the main switching unit 59 is typically constructed with a plurality of serially-connected large-current-capacity elements. However, this construction of the main switching unit 59 increases the production cost of the PDP driving apparatus. Therefore, there is a need to improve the PDP driving apparatus.

FIG. 6 shows another example of the X driver for the PDP driving apparatus of FIG. 2. FIG. 7 is a waveform diagram of a sustain pulse applied to the sustain electrode lines in a sustain discharge period PS by the X driver of FIG. 6.

The X driver 208 of FIG. 6 has a similar construction to that of the X driver of FIG. 5. The X driver 208 of FIG. 6 includes a first voltage switching unit 155, a second voltage switching unit 157, and an energy recovery circuit 153. The first voltage switching unit 155 applies a sustain pulse having the sustain discharge voltage Vs and the ground voltage Vg to the panel capacitor Cp, and the second voltage switching unit 157 applies the bias voltage Ve to the panel capacitor Cp. The energy recovery circuit 153 collects charges in the discharge cells or emits collected charges into the discharge cells. The energy recovery circuit 153 is similar to the energy recovery circuit 53 of FIG. 5. However, instead of the main switching unit 59 of FIG. 5, the X driver 208 of FIG. 6 has an additional first diode D11 coupled with the first voltage source Vs in order to prevent influence of the bias voltage Ve (from the second switching unit 157) on the first voltage switching unit 155. Additionally, in an over-voltage clamping preventing unit 152, the cathode of the second diode D12 is coupled with the second voltage source Ve. Therefore, the production cost of the PDP driving apparatus may be reduced. Additionally, the influence of the bias voltage Ve on the first voltage switching unit 155 may be minimized. However, the over-voltage clamping preventing unit 152 has a clamping range (that is, a clamping performance) from the bias voltage Ve to the ground voltage Vg, instead of from the sustain discharge voltage Vs to the ground voltage Vg. According to this change in clamping performance, as FIG. 7 shows, the sustain pulse applied to the sustain electrode lines X1, . . . , Xn in the sustain discharge period PS may increase up to the bias voltage Ve, so that overshoot occurs. The overshoot negatively affects the PDP's performance since it causes unstable light emission in the sustain discharge period PS.

SUMMARY OF THE INVENTION

The present invention provides a plasma display panel driving apparatus capable of reducing production cost and that may improve clamping performance.

Additional features of the invention will be set forth in the description which follows, and in part will be apparent from the description, or may be learned by practice of the invention.

The present invention discloses a PDP driving apparatus for applying a voltage to an electrode of the PDP. The apparatus includes a first voltage switching unit having a first diode having an anode coupled with a first voltage source, a first switching element coupled with a cathode of the first diode to apply a first voltage to the electrode, and a second switching element coupled with a ground to apply a ground voltage to the electrode. A second voltage switching unit has a third switching element coupled with a second voltage source to apply a second voltage, which is higher than the first voltage, to the electrode. An energy recovery circuit has an inductor coupled between the first and second switching elements, and an over-voltage clamping preventing unit to maintain a connection node, which is coupled with the electrode through the inductor, in a voltage range from the first voltage to the ground voltage. The over-voltage clamping preventing unit comprises a second diode coupled with the connection node, a third diode coupled with the connection node, and a fourth switching element having a first terminal coupled with a cathode of the second diode and a second terminal coupled with the first voltage source. An anode of the third diode is coupled with the ground.

The present invention also discloses a PDP driving apparatus for applying a voltage to an electrode of the PDP including a first voltage applying unit to apply a first voltage and a third voltage to the electrode, a second voltage applying unit to apply a second voltage, which is higher than the first voltage, to the electrode, and an energy recovery circuit including an inductor and an over-voltage clamping preventing unit. The over-voltage clamping preventing unit maintains a connection node, which is coupled with the electrode through the inductor, in a voltage range from the first voltage to the third voltage. The over-voltage clamping preventing unit includes a second diode coupled with the connection node, a third diode coupled with the connection node, and a fourth switching element having a first terminal coupled with the second diode and a second terminal coupled with a first voltage source that supplies the first voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
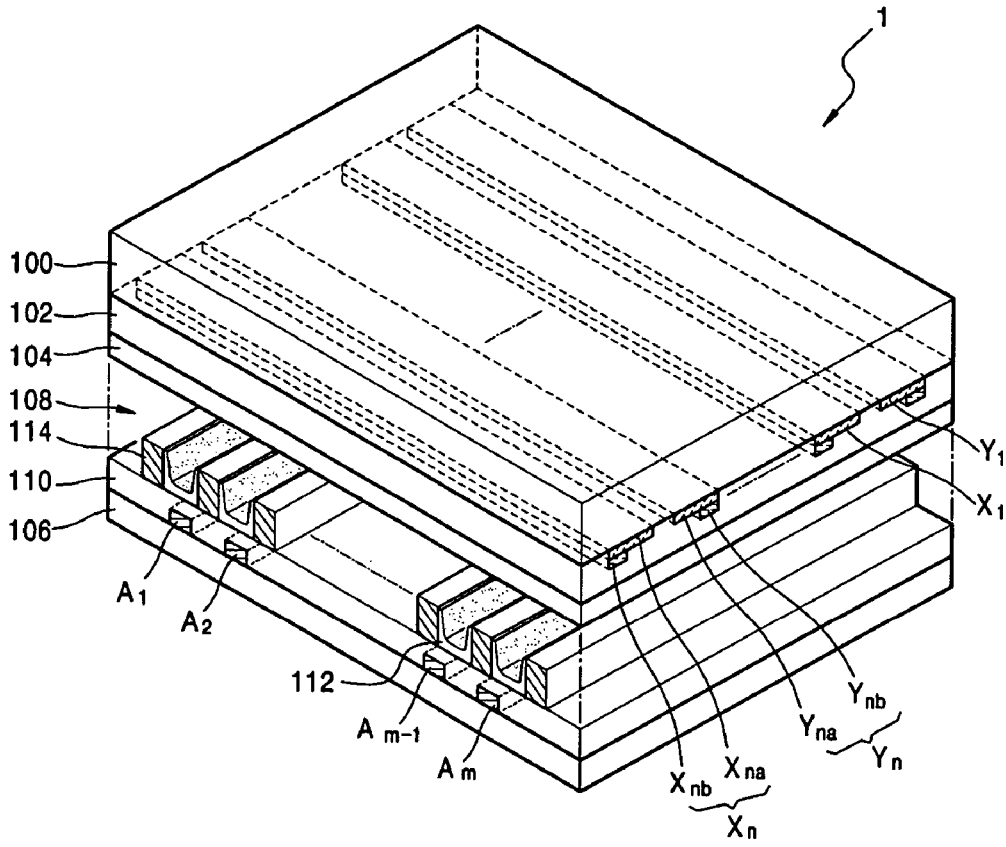
FIG. 1 (PRIOR ART)
FIG. 1 shows a conventional three-electrode surface discharge plasma discharge panel (PDP).
Figure 2:
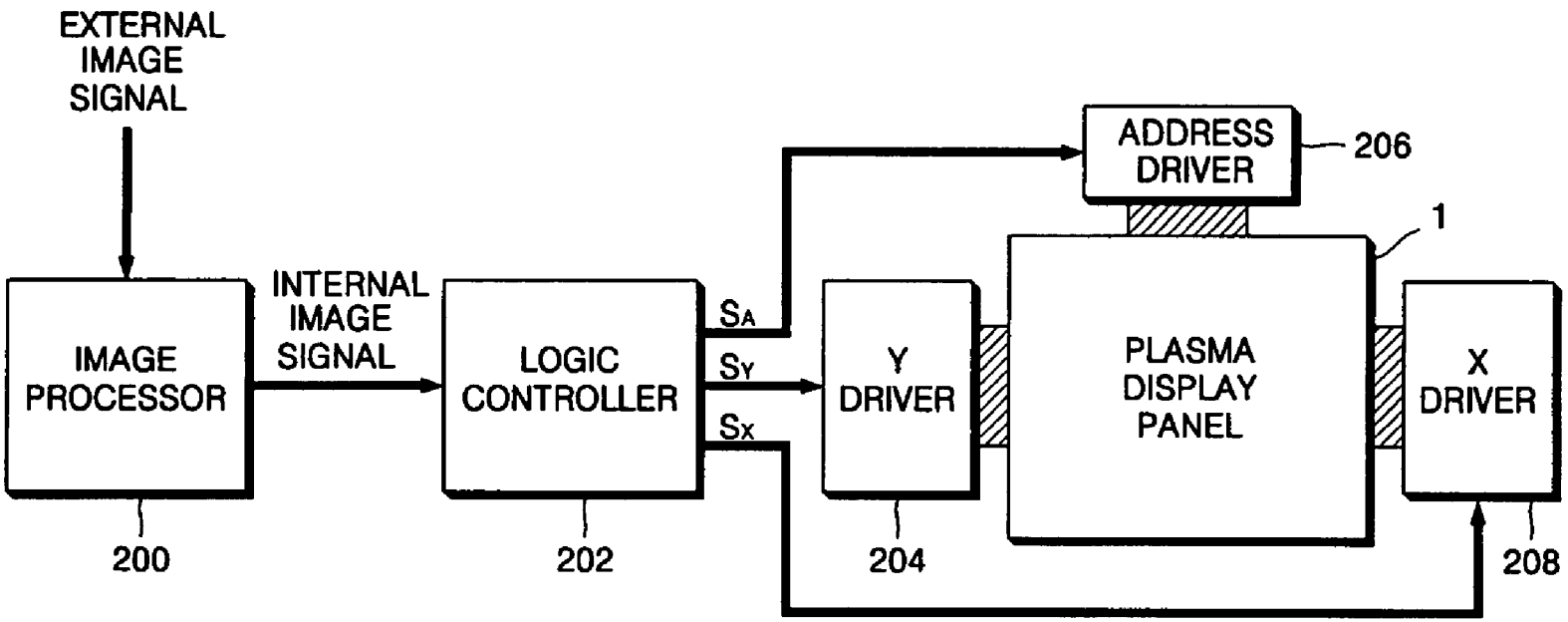
FIG. 2 (PRIOR ART)
FIG. 2 shows a conventional PDP driving apparatus for the PDP of FIG. 1.
Figure 3:
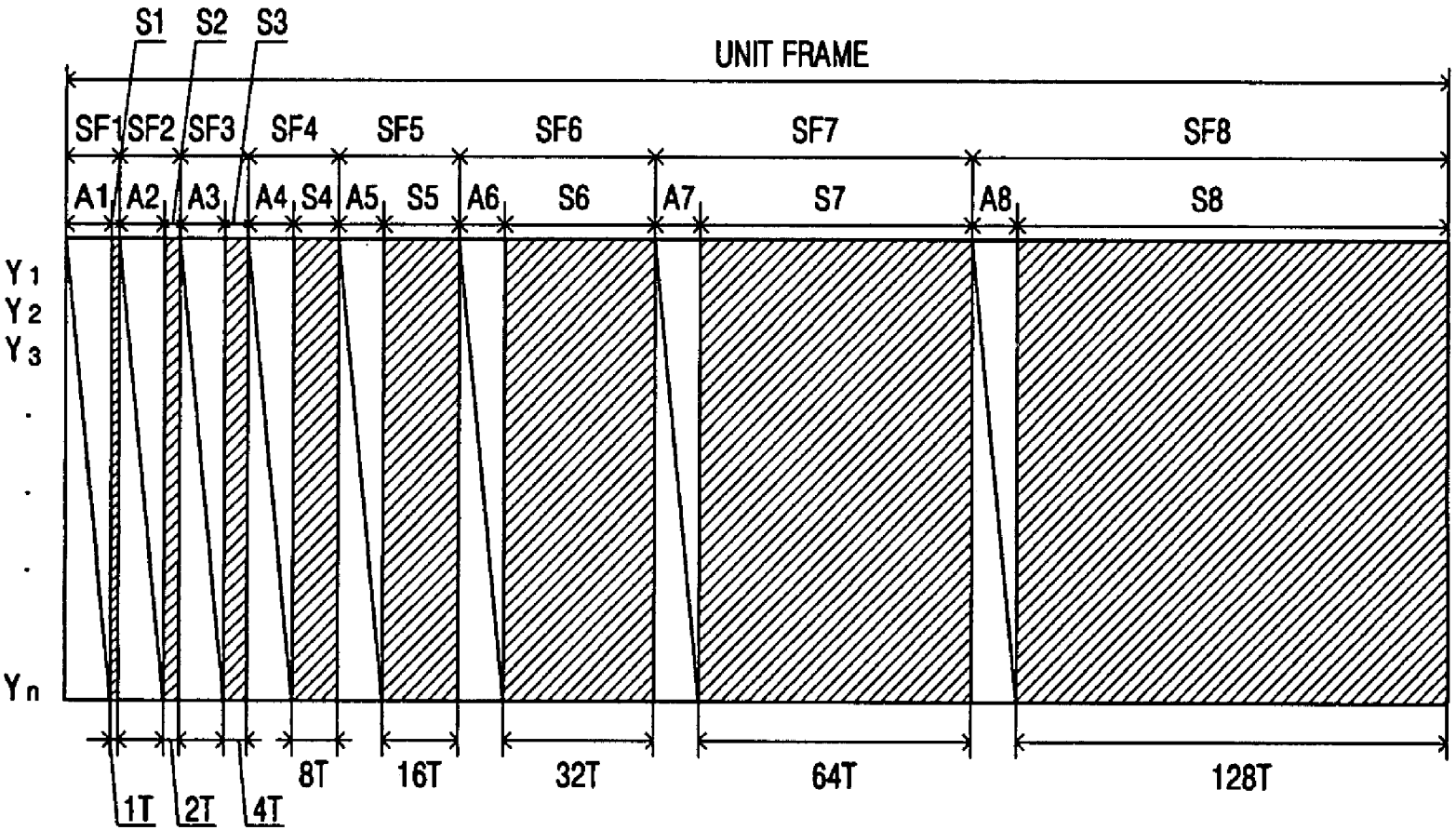
FIG. 3 (PRIOR ART)
FIG. 3 shows an address display separation (ADS) driving scheme for scan electrode lines in the PDP of FIG. 1.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

Figure 8:
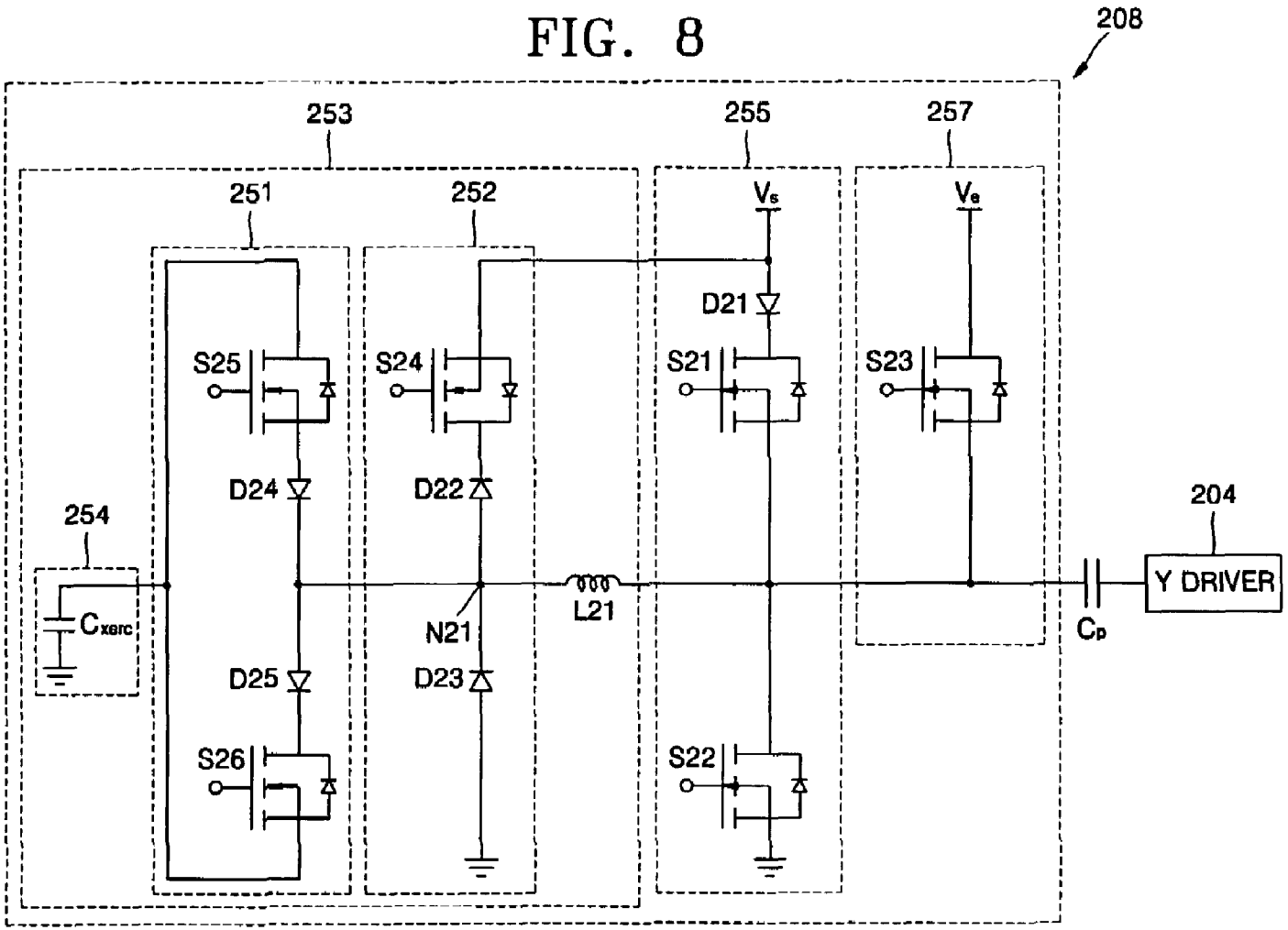
FIG. 8 shows an X driver of a PDP driving apparatus according to an exemplary embodiment of the present invention.
Figure 9:
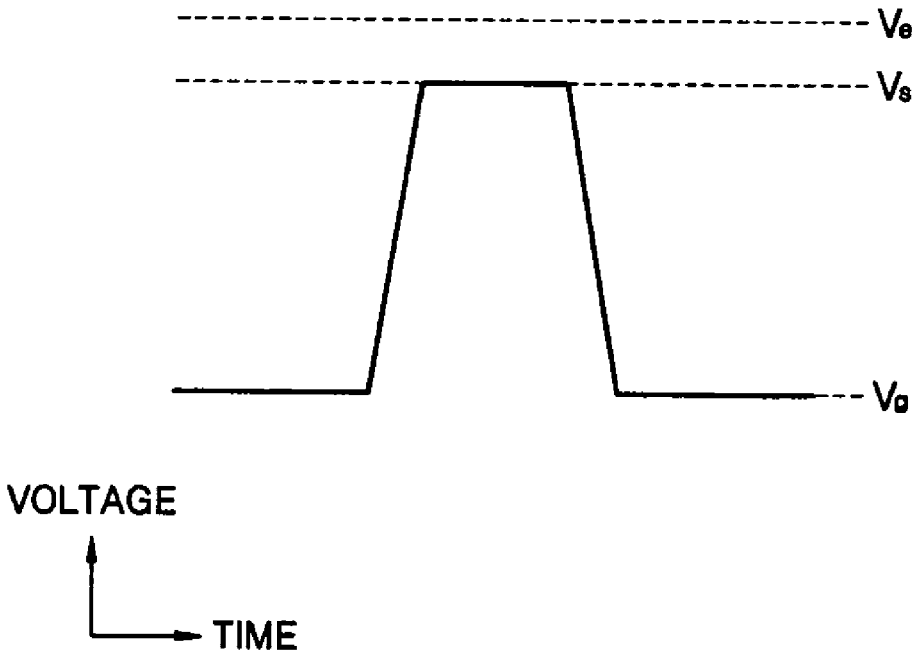
FIG. 9 shows a waveform of a sustain pulse output by the X driver of FIG. 8.
Figure 10:
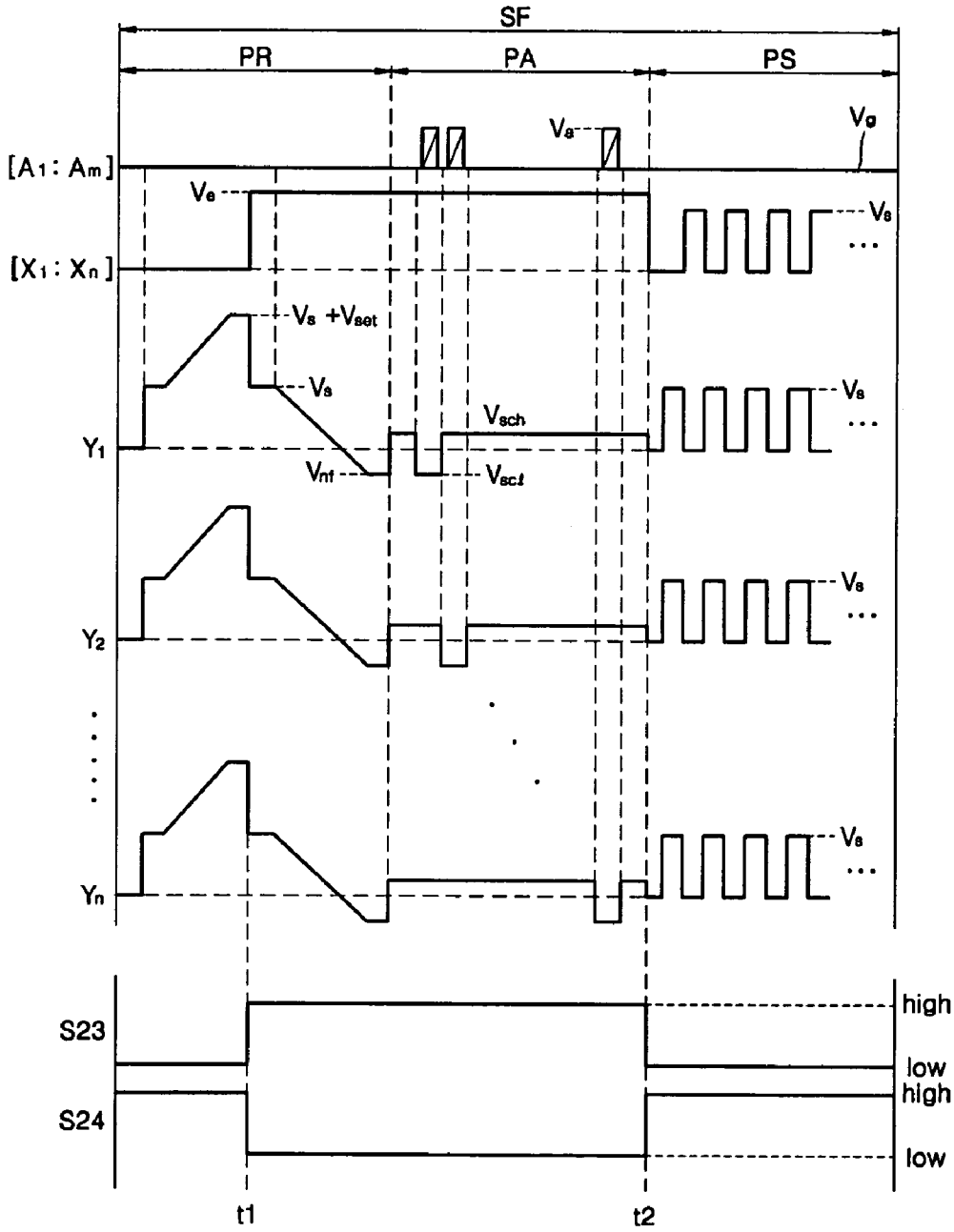
FIG. 10 shows a timing diagram for third and fourth switching elements of FIG. 8.

FIG. 8 shows an X driver of a plasma display panel (PDP) driving apparatus according to an exemplary embodiment of the present invention, and FIG. 9 shows a waveform of a sustain pulse applied to sustain electrode lines by the X driver of FIG. 8. FIG. 10 shows a timing diagram for third and fourth switching elements of FIG. 8.

Referring to FIG. 8, the PDP driving apparatus includes an X driver 208 and a Y driver 204, which are coupled with a panel capacitor Cp. The X driver 208 applies X driving signals to the panel capacitor Cp. The X driver 208 includes a first voltage switching unit 255, a second voltage switching unit 257, and an energy recovery circuit 253. The first voltage switching unit 255 applies a sustain pulse having the sustain discharge voltage Vs and the ground voltage Vg to the panel capacitor Cp, and the second voltage switching unit 257 applies the bias voltage Ve to sustain electrode lines. The energy recovery circuit 253 collects charges in the panel capacitor Cp and applies collected charges to the panel capacitor Cp.

The first voltage switching unit 255 includes a first diode D21 having an anode coupled with the sustain discharge voltage source Vs (first voltage source), a first switching element S21 coupled with a cathode of the first diode D21, and a second switching element S22 coupled with the ground. The first switching element S21 applies the sustain discharge voltage Vs to the panel capacitor Cp. The second switching element S22 applies the ground voltage Vg to the panel capacitor Cp.

The second voltage switching unit 257 includes a third switching element S23 coupled with the bias voltage source Ve (second voltage source). The third switching element S23 applies the bias voltage Ve to the panel capacitor Cp. The bias voltage Ve may be higher than the sustain discharge voltage Vs.

The energy recovery circuit 253 includes an inductor L21, an over-voltage clamping preventing unit 252, an energy recovery switching unit 251, and an energy storage unit 254. The inductor L21 has a first terminal coupled with the panel capacitor Cp, and the over-voltage clamping preventing unit 252 maintains a connection node N21 (a second terminal of the inductor L21) in a voltage range from the sustain discharge voltage Vs to the ground voltage Vg. The energy recovery switching unit 251 collects charges remaining in the panel capacitor Cp and applies collected charges to the panel capacitor Cp. The energy storage unit 254 stores the collected charges and emits the stored charges to the panel capacitor Cp.

The over-voltage clamping preventing unit 252 includes a second diode D22 coupled with the connection node N21, a third diode D23 coupled with the connection node N21, and a fourth switching element S24 having a first terminal coupled with a cathode of the second diode D22 and a second terminal coupled with the sustain discharge voltage source Vs. An anode of the third diode D23 is grounded.

The energy recovery switching unit 251 includes a fourth diode D24 coupled with the connection node N21, a fifth diode D25 coupled with the connection node N21, a fifth switching element S25 serially-coupled with an anode of the fourth diode D24, and a sixth switching element S26 serially-coupled with a cathode of the fifth diode D25.

The energy storage unit 254 includes a capacitor Cxerc.

The first through sixth switching elements S21-S26 may be field effect transistors (FET) or other devices that perform a similar switching function. An internal diode is provided to each FET. The anode and cathode of the internal diode are coupled with the source and drain of the FET, respectively.

As shown in FIG. 8, the source and drain of the first switching element S21 are coupled with the panel capacitor Cp and the cathode of the first diode D21, respectively. The source of the second switching element S22 is grounded, and the drain of the second switching element S22 is coupled with the panel capacitor Cp and the inductor L21. The source and drain of the third switching element S23 are coupled with the panel capacitor Cp and the second voltage source Ve, respectively. The source and drain of the fourth switching element S24 are coupled with the first voltage source Vs and the cathode of the second diode D22, respectively. The source and drain of the fifth switching element S25 are coupled with the anode of the fourth diode D24 and the energy storage capacitor Cxerc, respectively. The source and drain of the sixth switching element S26 are coupled with the energy storage capacitor Cxerc and the cathode of the fifth diode D25, respectively.

Figure 4:
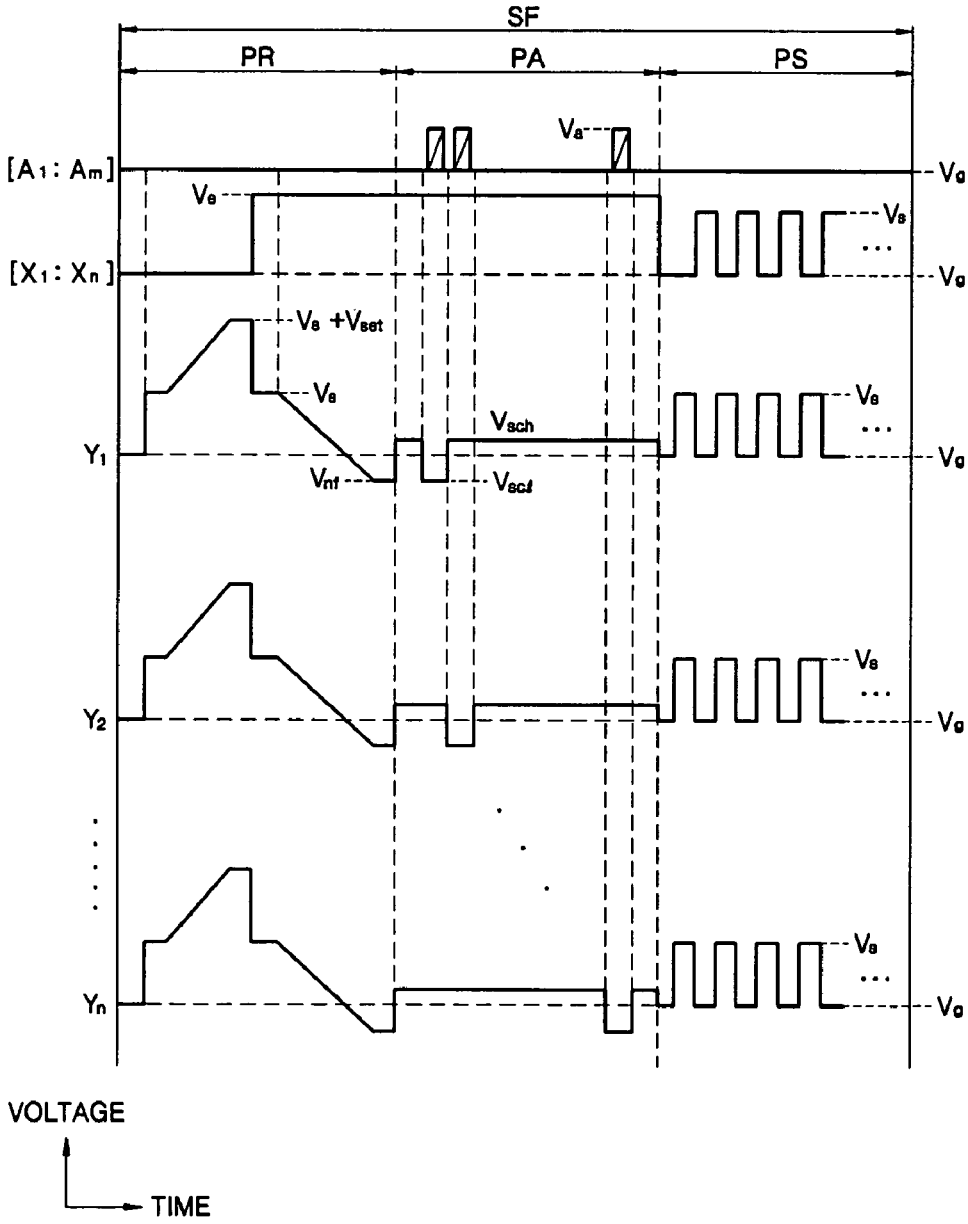
FIG. 4 (PRIOR ART)
FIG. 4 shows a timing diagram of driving signals used for the PDP of FIG. 1.
Figure 5:
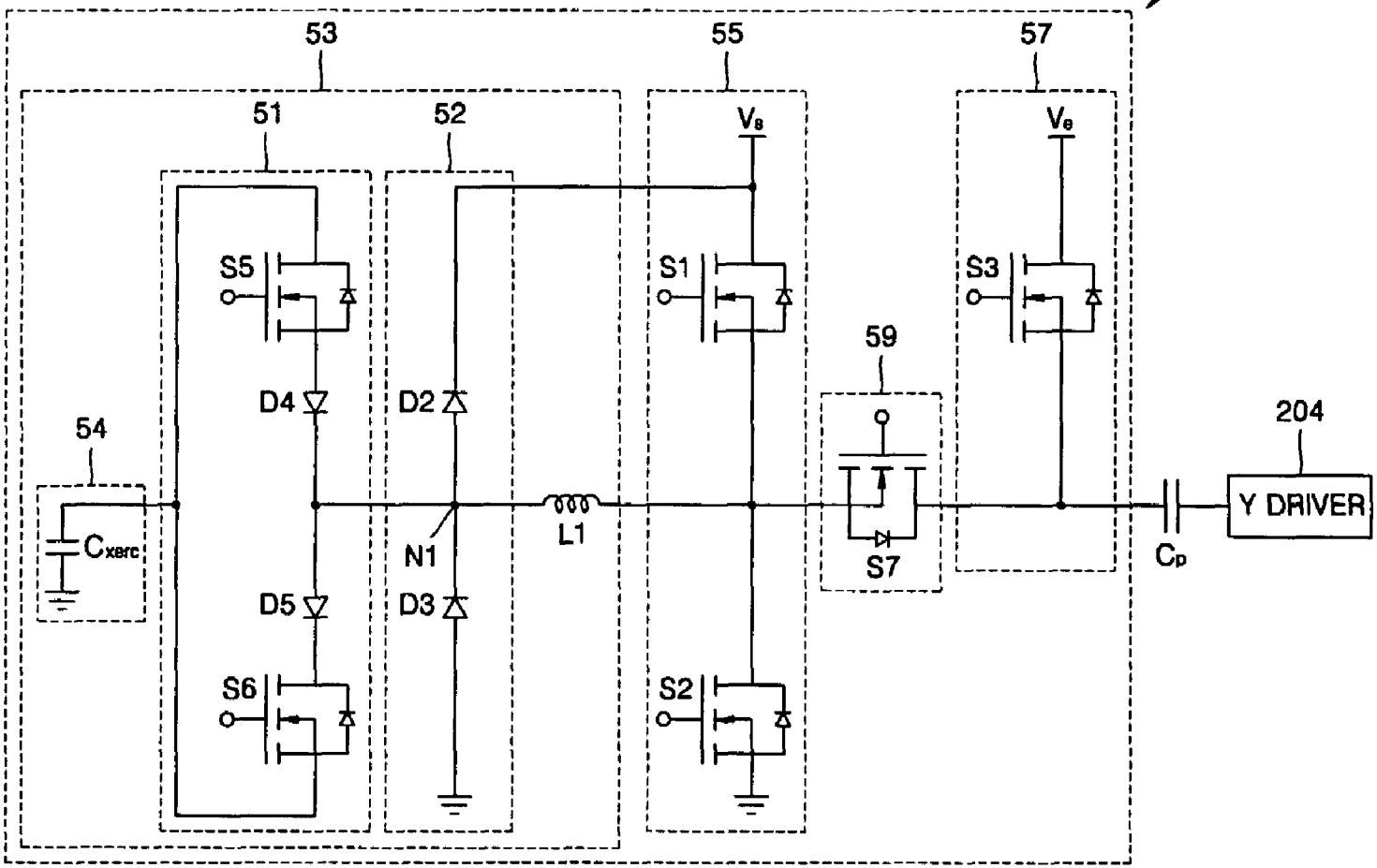
FIG. 5 (PRIOR ART)
FIG. 5 shows an example of an X driver that may be used in the PDP driving apparatus of FIG. 2.

Now, operations of the X driver 208 will be described with reference to FIG. 9 and FIG. 10. Since the waveforms shown in FIG. 10 that may be applied to the address, sustain, and scan electrodes are similar to those of FIG. 4, a detailed description is omitted here.

In order to apply the bias voltage Ve to the panel capacitor Cp for a portion of the reset period PR and during the address period PA, the third switching element S23 of the second voltage switching unit 257 is turned on at time t1 by increasing a signal from a low level to a high level. Here, due to the first diode D21 of the first voltage switching unit 255, the bias voltage Ve does not substantially affect the first voltage switching unit 255. Additionally, the fourth switching element S24 of the over-voltage clamping preventing unit 252 is turned off at time t1 by decreasing a signal from a high level to a low level, so that the bias voltage Ve does not substantially affect the first voltage source Vs.

Figure 6:
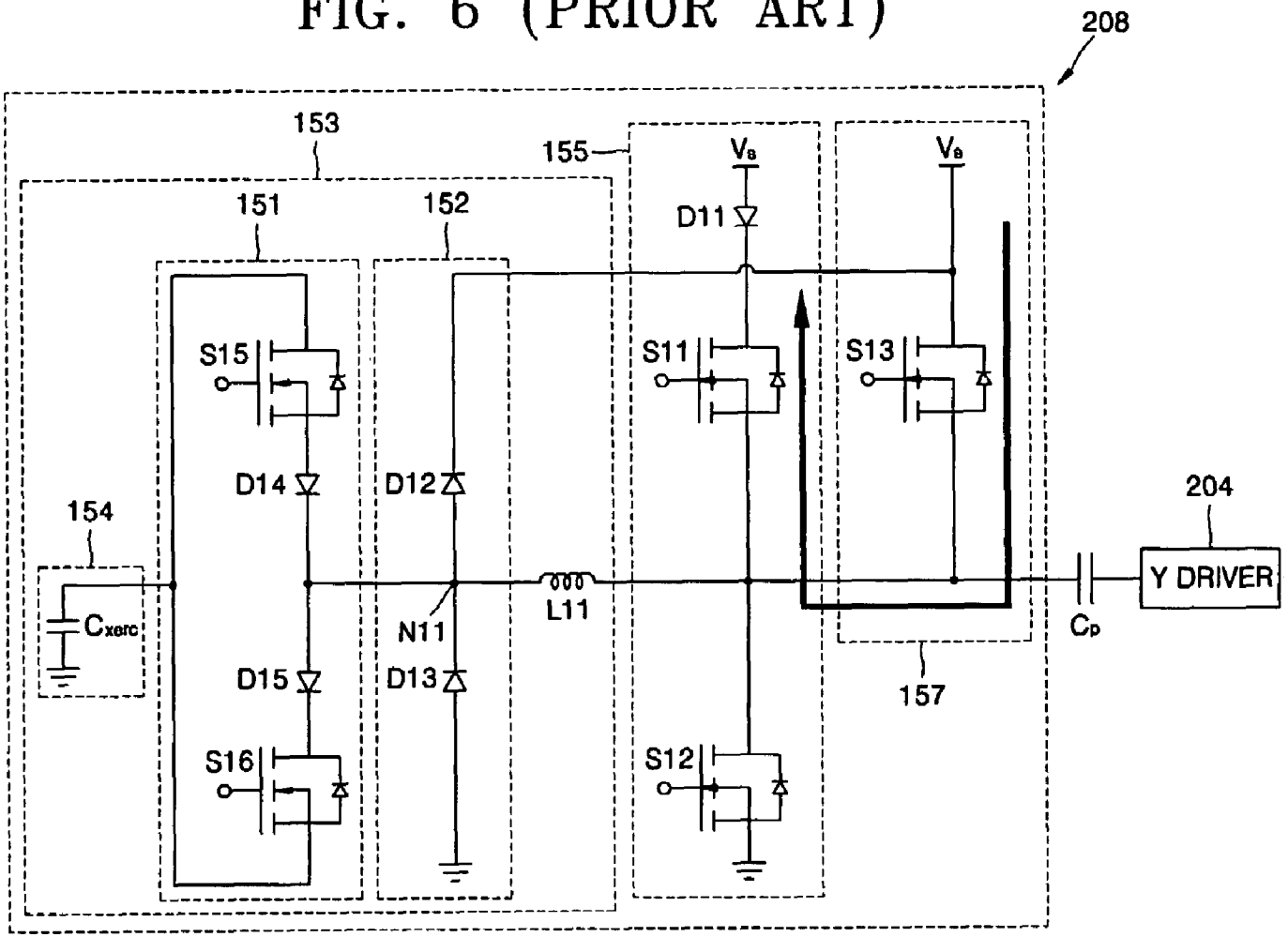
FIG. 6 (PRIOR ART)
FIG. 6 shows another example of an X driver that may be used in the PDP driving apparatus of FIG. 2.
Figure 7:
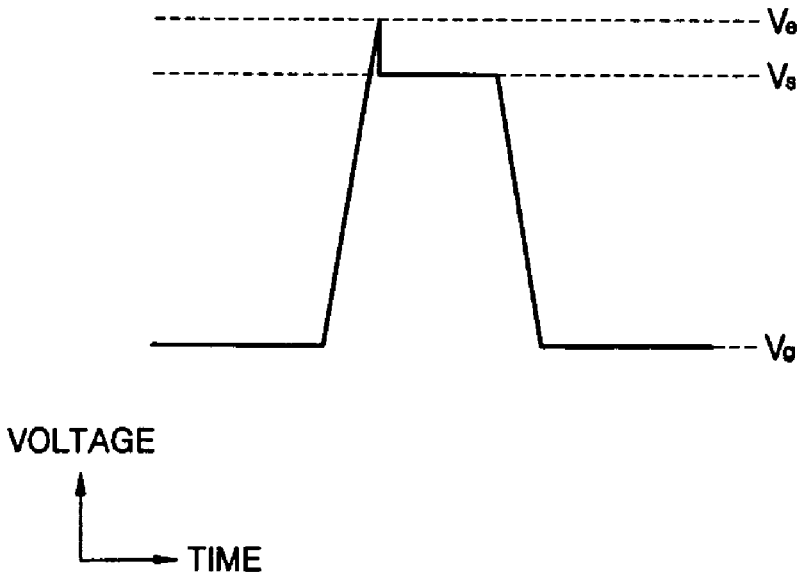
FIG. 7 (PRIOR ART)
FIG. 7 is a waveform of a sustain pulse output by the X driver of FIG. 6.

In order to alternately apply the sustain discharge voltage Vs and the ground voltage Vg during the sustain discharge period PS, the first and second switching elements S21 and S22 of the first voltage switching unit 255 are alternately turned on and off, the third switching element S23 is turned off at time t2 by decreasing a signal from a high level to a low level, and the fourth switching element S24 for clamping is turned on at time t2 by increasing a signal from a low level to a high level. Unlike the X driver of FIG. 6, the over-voltage clamping preventing unit 252 of the X driver of FIG. 8 is coupled with the first voltage source Vs instead of the second voltage source Ve. Hence, the clamping performance of the X driver 208 may be improved. Additionally, since the over-voltage clamping preventing unit 252 includes the fourth switching element S24, the bias voltage Ve does not substantially affect the first voltage source Vs. FIG. 9 shows the improved clamping performance. Unlike with the sustain pulse of FIG. 7, with the sustain pulse of FIG. 9, there is substantially no overshoot due to the bias voltage Ve, and a stable sustain discharge voltage Vs may be obtained. On the other hand, although a surge current that causes electromagnetic interference (EMI) noise may occur in the second diode D22 of the over-voltage clamping preventing unit 252, the fourth switching element S24 may reduce the surge current with an operating resistance Rds (on) of the FET. Unlike a conventional system, which uses a low-operating-resistance FET to reduce power consumption, it is possible to use a high-operating-resistance FET.

If the sustain pulse having the sustain discharge voltage Vs and the ground voltage Vg is continuously applied, the power consumption of the panel capacitor Cp increases. The energy recovery circuit 253 operates to solve this problem. Additionally, the capacitor Cxerc of the energy storage unit 254 may be charged at a predetermined voltage. When the sustain discharge voltage Vs is applied to the panel capacitor Cp, the sixth switching element S26 of the energy recovery switching unit 251 is turned on in order to collect the charges on the panel capacitor Cp. When the ground voltage Vg is applied to the panel capacitor Cp, the fifth switching element S25 is turned on in order to apply collected charges to the panel capacitor Cp.

According to a plasma display panel driving apparatus of an exemplary embodiment of the present invention, the following effects may be obtained.

First, since an over-voltage clamping preventing unit of an energy recovery circuit in an X driver includes a fourth switching element, it is possible to improve a clamping performance, even when a bias voltage is higher than a sustain discharge voltage. Further, it is possible to minimize the influence of the bias voltage on a first voltage source.

Second, when the fourth switching element comprises an FET, a low-operating-resistance FET is typically used to reduce power consumption. However, according to an exemplary embodiment of the present invention, a high-operating-resistance may be used for the fourth switching element to minimize the influence of a surge current flowing in a second diode D22 of the over-voltage clamping preventing unit, thereby reducing EMI noise caused by the surge current.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel driving apparatus for applying a voltage to an electrode of the plasma display panel, comprising:

a first voltage switching unit comprising a first diode having an anode coupled with a first voltage source, a first switching element coupled with a cathode of the first diode to apply a first voltage to the electrode, and a second switching element coupled with a ground to apply a ground voltage to the electrode;

a second voltage switching unit comprising a third switching element coupled with a second voltage source to apply a second voltage to the electrode, the second voltage being higher than the first voltage; and an energy recovery circuit comprising an inductor coupled between the first switching element and the second switching element, and an over-voltage clamping preventing unit to maintain a connection node, which is coupled with the electrode through the inductor, in a voltage range from the first voltage to the ground voltage, wherein the over-voltage clamping preventing unit comprises a second diode coupled with the connection node, a third diode coupled with the connection node, and a fourth switching element having a first terminal coupled with a cathode of the second diode and a second terminal coupled with the first voltage source, and wherein an anode of the third diode is coupled with the ground.

2. The plasma display panel driving apparatus according to claim 1, wherein the energy recovery circuit further comprises:

an energy recovery switching unit comprising a fourth diode coupled with the connection node, a fifth diode coupled with the connection node, a fifth switching element serially-coupled with an anode of the fourth diode, and a sixth switching element serially-coupled with a cathode of the fifth diode; and an energy storage unit coupled between the fifth switching element and the sixth switching element, wherein the energy recovery switching unit collects charges remaining in a discharge cell corresponding to the electrode and applies the collected charges to the discharge cell, and according to operations of the fifth switching element and the sixth switching element.

3. The plasma display panel driving apparatus of claim 2, wherein each switching element comprises a field effect transistor (FET) having a source, a drain, and a gate.

4. The plasma display panel driving apparatus of claim 3, wherein the source of the first switching element is coupled with the electrode, the source of the second switching element is coupled with the ground, the source of the third switching element is coupled with the electrode, the source of the fourth switching element is coupled with the first voltage source, the source of the fifth switching element is coupled with the anode of the fourth diode, and the drain of the sixth switching element is coupled with the cathode of the fifth diode.

5. The plasma display panel driving apparatus of claim 4, wherein the fourth switching element is turned off if the third switching element is turned on, and the fourth switching element is turned on if the third switching element is turned off.

6. The plasma display panel driving apparatus of claim 5, wherein the first voltage is a sustain discharge voltage that is applied to the electrode in a sustain discharge period to generate a sustain discharge.

7. The plasma display panel driving apparatus of claim 6, wherein the second voltage is a bias voltage that is applied to the electrode in a reset period and an address period.

8. A plasma display panel driving apparatus for applying a voltage to an electrode of the plasma display panel, comprising:

a first voltage applying unit to apply a first voltage and a third voltage to the electrode;

a second voltage applying unit to apply a second voltage to the electrode, the second voltage being higher than the first voltage; and an energy recovery circuit comprising an inductor and an over-voltage clamping preventing unit, wherein the over-voltage clamping preventing unit maintains a connection node, which is coupled with the electrode through the inductor, in a voltage range from the first voltage to the third voltage, the over-voltage clamping preventing unit comprising:

a second diode coupled with the connection node, a third diode coupled with the connection node, and a fourth switching element having a first terminal coupled with the second diode and a second terminal coupled with a first voltage source that supplies the first voltage.

9. The plasma display panel driving apparatus of claim 8, wherein the first voltage applying unit comprises a first diode having an anode coupled with the first voltage source, a first switching element coupled with a cathode of the first diode to apply the first voltage to the electrode, and a second switching element coupled with a third voltage source to apply the third voltage to the electrode;

wherein the second voltage applying unit comprises a third switching element coupled with a second voltage source to apply the second voltage to the electrode;

wherein the inductor is coupled between the first switching element and the second switching element; and wherein the first terminal of the fourth switching element is coupled with a cathode of the second diode, and an anode of the third diode is coupled with the third voltage source.

10. The plasma display panel driving apparatus according to claim 9, wherein the energy recovery circuit further comprises:

an energy recovery switching unit comprising a fourth diode coupled with the connection node, a fifth diode coupled with the connection node, a fifth switching element serially-coupled with an anode of the fourth diode, and a sixth switching element serially-coupled with a cathode of the fifth diode; and an energy storage unit coupled between the fifth switching element and the sixth switching element, wherein the energy recovery switching unit collects charges remaining in a discharge cell corresponding to the electrode and applies the collected charges to the discharge cell, and wherein the energy storage unit stores the collected charges and emits the stored charges according to operations of the fifth switching element and the sixth switching element.

11. The plasma display panel driving apparatus of claim 10, wherein each switching element comprises a field effect transistor (FET) having a source, a drain, and a gate.

12. The plasma display panel driving apparatus of claim 11, wherein the source of the first switching element is coupled with the electrode, the source of the second switching element is coupled with the third voltage source, the source of the third switching element is coupled with the electrode, the source of the fourth switching element is coupled with the first voltage source, the source of the fifth switching element is coupled with the anode of the fourth diode, and the drain of the sixth switching element is coupled with the cathode of the fifth diode.

13. The plasma display panel driving apparatus of claim 12, wherein the fourth switching element is turned off if the third switching element is turned on, and the fourth switching element is turned on if the third switching element is turned off.

14. The plasma display panel driving apparatus of claim 13, wherein the first voltage is a sustain discharge voltage that is applied to the electrode in a sustain discharge period to generate a sustain discharge.

15. The plasma display panel driving apparatus of claim 14, wherein the second voltage is a bias voltage that is applied to the electrode in a reset period and an address period.

16. The plasma display panel driving apparatus of claim 15, wherein the third voltage is a ground voltage.

* * * * *